US008881666B2

(12) United States Patent
Igari

(10) Patent No.: US 8,881,666 B2
(45) Date of Patent: Nov. 11, 2014

(54) SHIP

(75) Inventor: Seiichi Igari, Tokyo (JP)

(73) Assignee: SI Co. Ltd., Bunkyo-ku, Tokyo (JP)

( * ) Notice: Subject to any disclaimer, the term of this patent is extended or adjusted under 35 U.S.C. 154(b) by 88 days.

(21) Appl. No.: 13/572,124

(22) Filed: Aug. 10, 2012

(65) Prior Publication Data

US 2014/0041571 A1 Feb. 13, 2014

(51) Int. Cl.
*B63B 1/32* (2006.01)

(52) U.S. Cl.
USPC ..... 114/288; 114/290; 440/69

(58) Field of Classification Search
CPC ..... B63B 1/20; B63B 1/042; B63B 1/38; B63B 1/18; Y02T 70/122; B63H 5/14; B63H 5/16; B63H 5/125
USPC ..... 114/288, 289, 290, 162; 440/68, 69
See application file for complete search history.

(56) References Cited

U.S. PATENT DOCUMENTS 3,823,684 A * 7/1974 Baggs ..... 440/43
3,937,173 A * 2/1976 Stuart ..... 440/69
4,609,360 A * 9/1986 Whitehead ..... 440/69
4,977,845 A * 12/1990 Rundquist ..... 114/289
5,833,502 A * 11/1998 Anderson ..... 440/69

FOREIGN PATENT DOCUMENTS

JP 2005-246996 A 9/2005
JP 2007-186204 A 7/2007
JP 2009-119934 A 6/2009
JP 2011-121569 A 6/2011
JP 2011-140293 A 7/2011
JP 2011-225169 A 11/2011

* cited by examiner

*Primary Examiner* — Lars A Olson
(74) *Attorney, Agent, or Firm* — McGlew and Tuttle, P.C.

(57) ABSTRACT

A ship has a water flow forming path (3) formed in a bottom (2), and a propeller (6) disposed in the path (3) and a rudder (8) on a rear side of the propeller (6). A movable side of the rudder (8) faces toward a bow (1*a*). As a result of this, thrust increases due to generation of a rapid stream by the propeller (6) in the path (3), the propulsion performance improves and the steering performance improves because the rapid stream in the path (3) acts on the rudder (8). An outboard motor (14) may be provided with a vertical channel (13) in a stern (4) of the boat. Replacement can be made through the vertical channel (13). As the propeller (6) of the outboard motor (14) is recessed, it is possible to pull the boat onto the beach while leaving the outboard motor (14) as it is.

20 Claims, 5 Drawing Sheets

FIG. 12
Fig 12 (A)
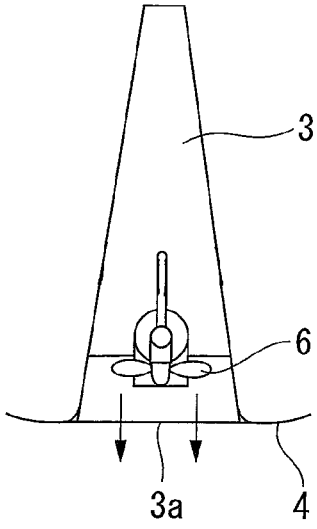
Fig 12 (B)
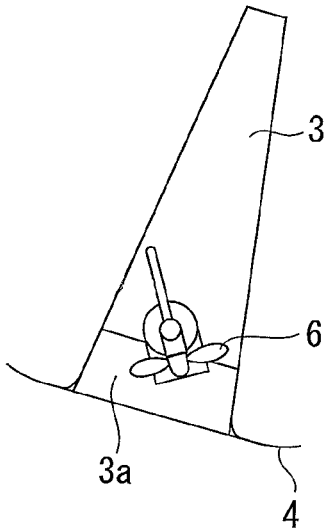
Fig 12 (C)
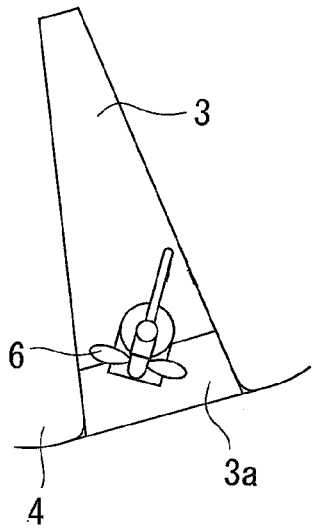

SHIP

BACKGROUND OF THE INVENTION

1. Field of the Invention

The present invention relates to ships including motorboats, pleasure boats, passenger ships, cargo ships, warships, and boats with outboard motors, and more particularly, to a ship with improved propulsive performance in order to save energy and with improved steering performance, and also to a rescue boat whose navigation is not hindered by floating matters on the water, obstacles in the water or the like.

2. Description of the Related Art

An existing ship has a propulsion propeller (screw propeller) and a rudder exposed at the back of hull's bottom, which has not changed basically ever since the ship began to propel with power. Meanwhile, many proposals have been made to improve the propulsive performance and the steering performance, examples of which will be presented as follows.

Improvement in Propulsive Performance

Japanese Unexamined Patent Application Publication No. 2011-225169 discloses a ship having a stern pipe in a stern, the stern pipe being projected from the stern toward the back of a hull, and rotatably supporting a rotary shaft of a propeller. The ship includes fins that are disposed on right and left sides of the stern, extended toward the outside of hull width direction and toward the upside of the hull from the stern near the stern pipe, and shield stern vortices S generated at the stern in radial direction from vortex centers X of the stern vortices S.

Japanese Unexamined Patent Application Publication No. 2011-140293 discloses a propulsion performance improving device for a ship having a superior effect with comparatively simple constitution, which can improve propulsion efficiency by increasing swirling water flows in direction opposite to propeller advancing rotating direction to allow the swirling water flows to flow in the propeller and to reduce rotating flows on a rear side of the propeller, and can prevent an increase in drag of the device itself. This propulsion performance improving device includes rear fins having twisting angles larger than those of conventional fins, and front fins located in a front region and having twisting angles smaller than those of the conventional fins. Drag of the front fins and the rear fins is not increased as compared with the conventional fins, and a reduction effect of a propeller real' rotating flow is increased. As a result, the ship has better propulsion performance improving effect than that of the conventional ship, and less horsepower is required when the hull is navigated.

Japanese Unexamined Patent Application Publication No. 2011-121569 discloses a propulsion performance improving device of a ship capable of preventing a propeller from being damaged by a vortex generated by reaction fins. This propulsion performance improving device for improving propulsion performance of the ship includes a plurality of reaction fins that are arranged on a front side of the propeller to generate a swirling flow in direction opposite to rotational direction of the propeller, and that are radially extending with a rotary shaft S of the propeller as the center. The plurality of reaction fins include the reaction fin extending in obliquely upward direction and the reaction fins extending in horizontal direction or obliquely downward direction. A first distance to a blade end of the reaction fin from the rotary shaft S is larger than a propeller radius of the propeller. A second distance to a blade end of the reaction fin from the rotary shaft S is set to be smaller than the propeller radius.

Improvement in Steering Performance

Japanese Unexamined Patent Application Publication No. 2009•119934 discloses a ship rudder for enhancing course keeping performance of a ship by reducing rudder drag during forward movement of the ship with a simple method and reducing meeting rudder drag in a minute steering angle as small as possible, by improvement of a lower end of a conventional ship rudder having an inverted trapezoidal side shape. The rudder at a stern is equipped with an additive object, as being a flat spindle body having an airfoil vertical cross section slightly projecting outward, on a lower end of the rudder body having the inverted trapezoidal side shape. A center line of a vertical cross section of the additive object is inclined backward and obliquely upward, and an inclination angle a is set to be 4 to 10 degrees. Then, the additive object receives a stream toward a rear side of a ship's bottom near the rudder during navigation, so as to generate lift. As its forward component acts as thrust, the rudder drag can be reduced, and improved steering force can be expected at the time of steering.

Japanese Unexamined Patent Application Publication No. 2007-186204 discloses a rudder that has high lift and suppresses increase in rudder drag as small as possible. 'Ib obtain such a rudder, a horizontal cross section of a rudder body has an arc or similar shape at a front end portion. Its sectional width gradually increases toward a rear side of the rudder body, reaches the maximum width, and then, gradually decreases while changing from an outwardly projecting shape to an outwardly and gently recessed shape. Then, the rudde1' has a linear portion formed by approximately parallel lines continuing to the rear end of a finite width.

Japanese Unexamined Patent Application Publication No. 2005-246996 discloses a ship rudder capable of improving propulsive performance by efficiently converting rotational energy of a propeller wake at a shaft into lift, and improving rudder performance by increasing a rudder area. In the rudder arranged on a rear side of the propeller of a ship, fins to generate the lift from the propeller wake are provided on a front side or an obliquely front side of a rudder body with a space S in which the propeller wake flows between the propeller and the rudder body, so that span direction of the fins becomes vertical to the rudder.

According to the above described means for improving the propulsive performance, however, the propeller is entirely located in the water. With regard to drag acting on the propeller, thrust produced by the propeller is substantially reduced because the thrust is diminished and the thrust toward the rear side is dispersed by receiving wave drag.

Next, according to the above described means for improving the steering performance, water drag acting on the rudder becomes the steering force. The rudder is also entirely located in the water, and therefore it is impossible to obtain the sufficient steering force because of dispersion of the steering force in the surrounding water, the steering force being produced by making contact with water and determining the direction.

The above-described problems are challenges for the ships through all ages. In spite of various improvements and proposals made thus far, no conclusive proposal has been made up to the present date.

With the conventional ships such as rescue boats and boats with outboard motors, it may be difficult to approach its destination because there is a risk of damaging propellers and rudders due to floating matters on the water and rocks in the shallows.

With the boats with the outboard motors, the boat usually has a spare outboard motor because it cannot sail back home once the outboard motor is broken. However, there is a problem that replacement of the spare outboard motor takes time and effort especially when being alone. With the boats with the outboard motors, the propeller becomes obstructive when pulling the boat onto the ground (beach) and letting it down into the sea. Therefore, the outboard motor needs to be put on board each time, which is quite bothersome.

SUMMARY OF THE INVENTION

It is an object of the present invention to provide a ship capable of improving propulsive performance to reduce an amount of fuel and improving steering performance to secure navigational safety, and also a boat with an outboard motor capable of replacing the outboard motor over the ocean with ease.

To achieve the above-described object, a first aspect of the present invention provides a ship with improved propulsion and steering performance, including: a water flow forming path formed in a ship's bottom; and a propeller disposed in the water flow forming path and a rudder on a rear side of the propeller. A movable side of the rudder faces toward a bow.

According to this aspect of the present invention, the propeller is located inside the water flow forming path, and therefore thrust by the propeller produces a strong stream flowing in the water flow forming path toward the rear side in a concentrated way, and the stream is discharged as a strong jet flow from an outlet in a stern. As compared with the thrust by the conventional propeller that is entirely exposed under water, a propulsion force acting on the ship is increased to a great extent by the addition of the propulsion force by the propeller and the thrust by the jet flow, which makes it possible to increase speed of the ship and cut down on fuel expenditure.

Contrary to the conventional rudder facing backward, the movable side of the rudder is made to face forward (i.e. the direction of the rudder is opposite to that of the conventional rudder). The rudder facing forward receives the strong stream produced by the propeller to increase the steering force. Also, a radius of rotation can be decreased as compared with the conventional radius of rotation, so that the steering performance can be improved and risks can be avoided in case of emergency.

According to a second aspect of the present invention, with the ship according to the first aspect, a bow side of the water flow forming path is formed to have a slope from a surface of the ship's bottom (a surface of the hull) connecting to a path's bottom.

According to this aspect of the present invention, the water flow forming path gradually deepens from the middle of the ship's bottom through the slope. As a vortex current is not generated in the stream flowing into the water flow forming path, it is possible to minimize drag of the water.

According to a third aspect of the present invention, with the ship according to the first aspect, a stream is formed in the water flow forming path from an opening in a bow side of the water flow forming path.

This aspect of the present invention can be practically adapted to relatively small ships. Together with the second aspect, it is possible to improve forward movement performance of the ship and to reduce careen of the ship due to wave motion.

According to a fourth aspect of the present invention, with the ship according to anyone of the first to the third aspects, the water flow forming path is formed at positions symmetrical to each other with a center line of the ship's bottom as a boundary. Each water flow forming path is provided with a propeller and a rudder therein.

This aspect of the present invention can be practically adapted to small ships including motorboats, so as to achieve high-speed performance.

According to a fifth aspect of the present invention, with the ship according to anyone of the first to the fourth aspects, the water flow forming path is formed by partitions formed in parallel to protrude from an undersurface of the ship's bottom.

According to this aspect of the present invention, the water flow forming path can be formed only by providing the partitions on the undersurface of the ship's bottom, without making strength calculation of the hull again. Thus, implementation of this aspect is facilitated and reduction in costs can be achieved.

According to a sixth aspect of the present invention, with the ship according to anyone of the first to the fifth aspects, the ship comprises a motorboat, a small boat, a large ship, or a warship.

According to a seventh aspect of the present invention, when the ship according to the first aspect has an outboard motor, a vertical channel in communication with the water flow forming path is formed in a stern surface of the ship. The propeller is located inside the water flow forming path through the vertical channel.

According to this aspect of the present invention, it is easy to replace the outboard motor alone over the ocean. Even when an approach to the destination is difficult because there is material floating around the destination or the destination is in the shallows, it is possible for a rescue boat and a fishing boat to easily navigate and reach the destination by getting over obstacles, since the propeller is recessed from the ship's bottom. As the propeller is recessed from the surface of the ship's bottom into the water flow forming path, it is possible to pull the boat onto the beach and let it down into the sea while leaving the propeller as it is, which is quite convenient. Also, there is no risk of damaging the propeller and the rudder.

Effects of the Invention

According to the present invention, the propeller and the rudder are provided in the water flow forming path, so as to improve the propulsive performance to reduce an amount of fuel, and improve the steering performance.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

FIG. 12(A) is an explanatory view of a steering example of the outboard motor;

FIG. 12(B) is an explanatory view of another steering example of the outboard motor; and FIG. 12(C) is an explanatory view of a steering example of the outboard motor.

DESCRIPTION OF THE EMBODIMENTS

First Embodiment

Figure 1:
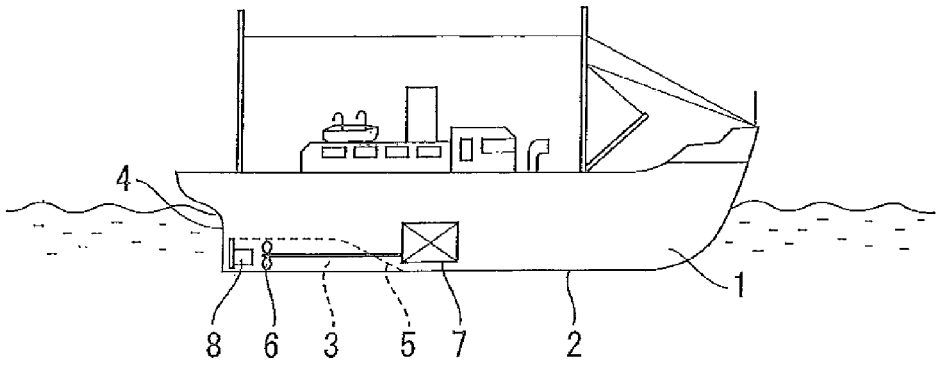
FIG. 1 is an explanatory view of a ship according to the present invention.
Figure 2:
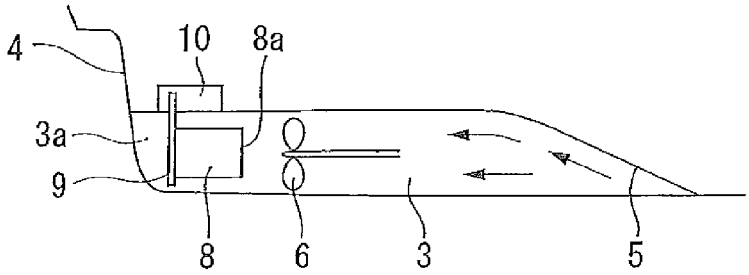
FIG. 2 is an explanatory side view of a water flow forming path, a propeller and a rudder.
Figure 3:
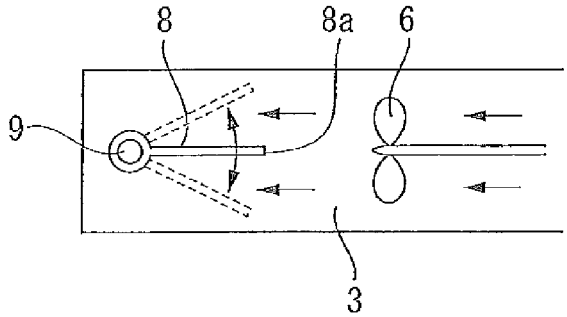
FIG. 3 is an explanatory plan view of the water flow forming path, the propeller and the rudder.
Figure 4:
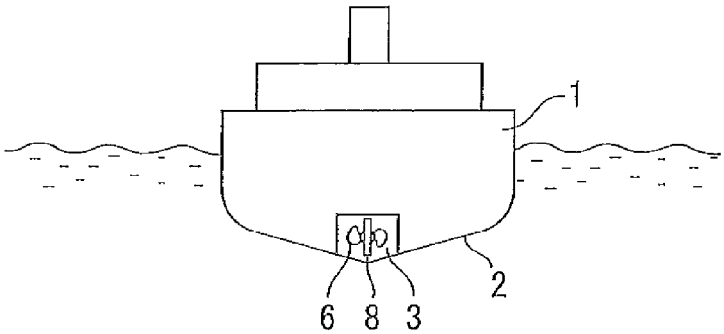
FIG. 4 is an explanatory rear view of the water flow forming path, the propeller and the rudder.

An embodiment of the present invention according to claims 1 and 2 will be explained in detail with reference to FIG. 1 to FIG. 4. In FIG. 1 to FIG. 4, a ship 1 as a whole, a ship's bottom 2, and a water flow forming path 3 are illustrated. The water flow forming path 3 is formed in the center of the ship's bottom toward a stern 4, and is a path having a gentle slope 5 on a bow side and an inversed U-shaped cross section toward a stern 4 side.

A propeller 6 is disposed on the stern 4 side in the water flow forming path 3, and driven by a power source 7.

A rudder 8 is disposed between the propeller 6 and a stern opening 3*a* in the water flow forming path 3. The rudder 8 is attached in such a manner that a movable side 8*a*, opposed to a spindle 9, faces the bow side, and steered by a steering gear 10.

With thus-structured ship, rotation of the propeller 6 forms a stream inside the water flow forming path 3, and the stream allows the ship 1 to go ahead. It is needless to say that, when the propeller 6 is reversely rotated, the ship 1 is allowed to go astern.

When the movable side 8*a* of the rudder 8 is rotated leftward (counterclockwise) by a predetermined angle while the ship 1 is going ahead, the stream inside the water flow forming path 3 strikes a front surface of the rudder 8 and the stern 4 is moved counterclockwise, so that the ship 1 makes a left turn.

When the rudder 8 is rotated clockwise, the ship 1 makes a right turn contrary to the above.

Thus, the propeller 6 of the ship 1 rotates within the limited space (in the water flow forming path 3) and receives reaction force from water in the limited space to move forward. Thrust by the propeller 6 is effectively transmitted to the water in the water flow forming path 3, and becomes large propulsive force to be transmitted to the ship 1.

Further, the water in the partitioned space in the water flow forming path 3 is discharged as a jet flow from the opening 3*a* in the stern 4, and thrust of the jet flow also acts on the ship 1.

As the rudder 8 is formed to face forward, the stream inside the water flow forming path 3 strikes the rudder 8 and flows to the stern 4 side by passing through space opposite to the direction of the rudder 8, so that rotating force further increases due to the stream. With the conventional rudder facing backward, on the contrary, it is only water drag acting on the rudder that contributes to the rotating force, and hence a radius of rotation inevitably increases.

Second Embodiment

Figure 5:
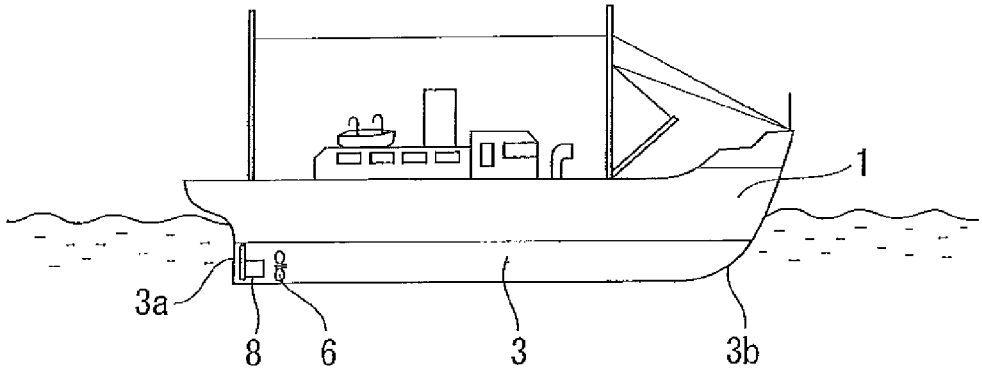
FIG. 5 is an explanatory view of a water flow forming path.

A second embodiment relates to a stream that is formed in the water flow forming path from an opening in a bow side of the water flow forming path. As shown in FIG. 5, a water flow forming path 3 has an inlet 3*b* on a bow 1*a* side, which is effectively adapted to relatively small ships.

Third Embodiment

Figure 6:
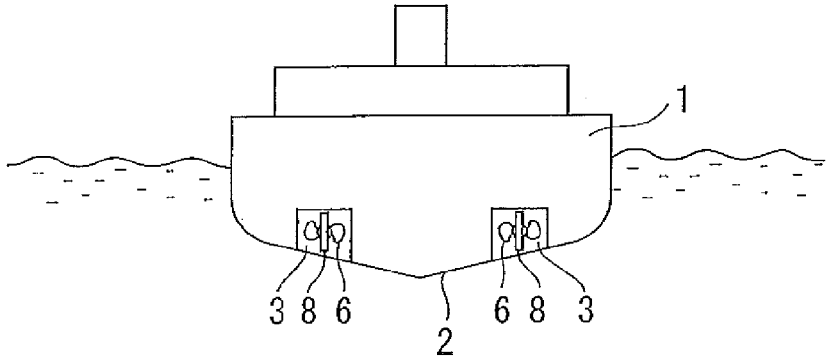
FIG. 6 is an explanatory view of an embodiment which has a water flow forming path, a propeller and a rudder formed at symmetrical positions in a ship's bottom.

A third embodiment relates to the water flow forming path being formed at positions symmetrical to each other with a center line of the ship's bottom as a boundary, and each water flow forming path is provided with a propeller and a rudder therein. As shown in FIG. 6, a water flow forming path 3, a propeller 6, and a rudder 8 are formed in a ship's bottom 2 at positions symmetrical to each other, which can be adapted to relatively small ships.

Fourth Embodiment

Figure 7:
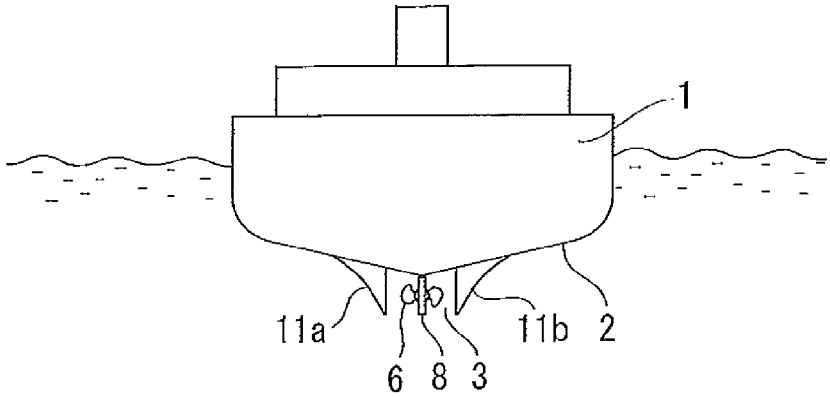
FIG. 7 is an explanatory view of an embodiment which forms a water flow forming path by weir walls on a ship's bottom.
Figure 8:
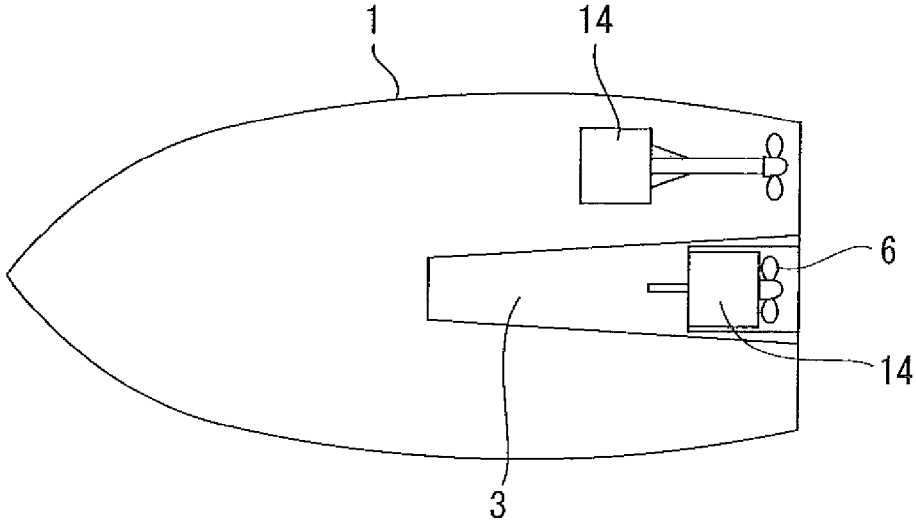
FIG. 8 is an explanatory of a ship's bottom surface of a boat with an outboard motor.
Figure 9:
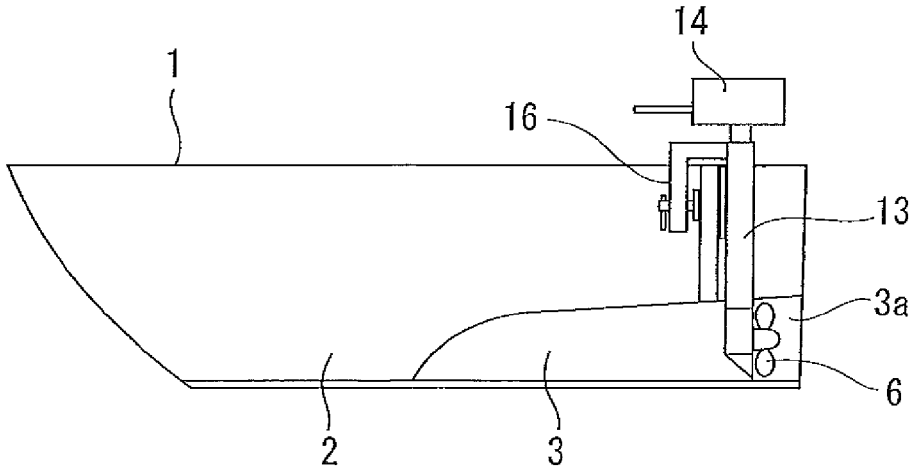
FIG. 9 is a side view of the boat with the outboard motor.

A fourth embodiment relates to the water flow forming path being formed by partitions formed in parallel to protrude from an undersurface of the ship's bottom. As shown in FIG. 7, weir walls 11*a*, 11*b* are provided in parallel to protrude from an undersurface of a ship's bottom 2 to form a water flow forming path 3 between the weir walls 11*a*, 11*b*, in contrast to the first embodiment in which the water flow forming path 3 is formed in the ship's bottom 2 to have the inversed U-shaped cross section. This combination of features is effectively adapted to tankers and large ships while achieving reduction in construction costs and avoiding reduction in capacity.

COMPARATIVE EXAMPLE 1

A performance comparison is made between the ship according to this embodiment and the conventional ship under the same conditions of size of the hull (boat), weight, engine output, and fuel. An example of the comparison is shown in Table 1.

TABLE 1

| | Speed (km/h) | Traction (kg) | Engine | |
|---|---|---|---|---|
| Ship of this embodiment | 30 | 15 | 29 cc | |
| Conventional ship | 20 | 10 | 29 cc | |
| Ship size (for both ships) | Total length: 170 cm | Breadth: 66 cm | Height: 40 cm | Curb weight: 20 kg |

Fifth Embodiment

A fifth embodiment corresponds to claim 7, and relates to a boat with an outboard motor and a rescue boat.

According to the fifth embodiment, the structure of a water flow forming path 3 is the same as that of the first embodiment. However, a vertical channel 13 in communication with the water flow forming path 3 is formed in a stern surface 4*a* of a boat or a rescue boat 12, and an outboard motor 14 is brought down through the vertical channel 13 into the water flow forming path 3 for attachment. By thus forming the vertical channel 13, replacement of the broken outboard motor 14 with a spare outboard motor 14*a* can be made only by pulling up the broken outboard motor 14 on board and bringing down the spare outboard motor 14*a*, so that a propeller 6 can be located inside the water flow forming path 3. Accordingly, it is easy to take action against a breakdown when even when operating the boat alone.

Figure 11:
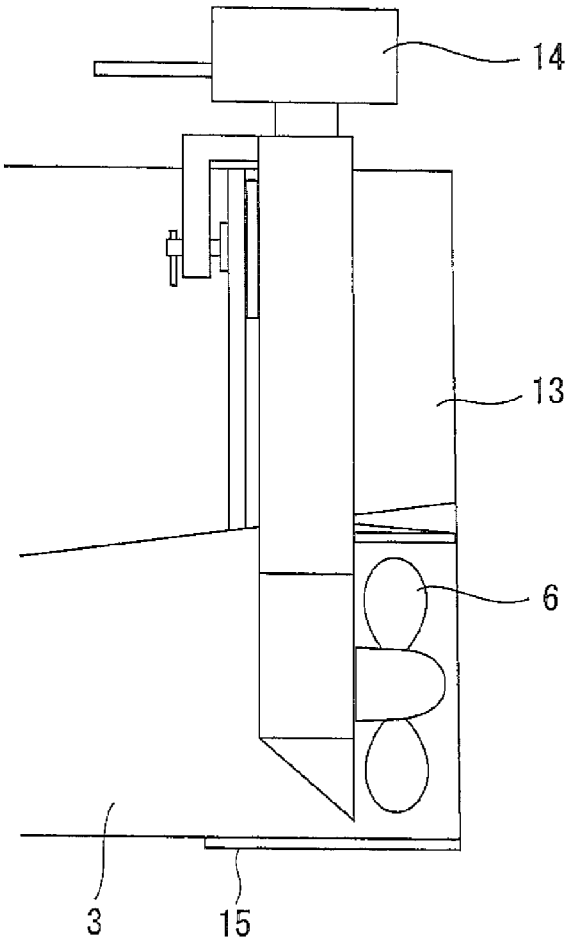
FIG. 11 is a side view showing an attachment of the outboard motor.
Figure 10:
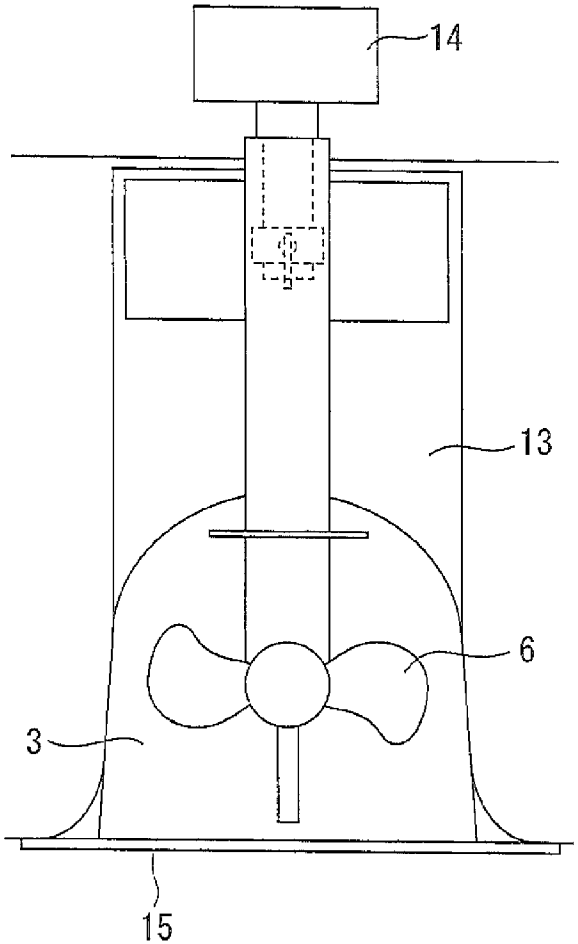
FIG. 10 is a front view of the boat with the outboard motor seen from direction of a stern.

Thus, the replacement of the outboard motor 14*a* can be easily made alone (without extensive support structure/manpower) in a short period of time. Further, as the propeller 6 does not protrude from an undersurface, it is possible to pull the boat onto the beach and let it down into the sea while leaving the outboard motor 14 as it is. In FIGS. 11 and 12, a guard plate 15 prevents the propeller 6 from being damaged, but the guard plate 15 may be omitted.

A clamp 16 for fixing the outboard motor 14 is illustrated.

FIG. 12(A) to FIG. 12(C) show examples of steering by the outboard motor. FIG. 12(A) shows the example of forward movement, FIG. 12(B) shows the example of a right turn, and FIG. 12(C) shows the example of a left turn.

While specific embodiments of the invention have been shown and described in detail to illustrate the application of the principles of the invention, it will be understood that the invention may be embodied otherwise without departing from such principles.

Appendix:

DESCRIPTION OF THE REFERENCE NUMERALS

1 ship
2 ship's bottom
3 water flow forming path
4 stern
5 slope
6 propeller
7 power source
8 rudder
8*a* movable side
9 spindle
10 steering gear
11*a*, 11*b* weir walls
12 rescue boat
13 vertical channel
14 outboard motor
14*a* spare outboard motor
15 guard plate

What is claimed is:

1. A ship with improved propulsion and steering performance, the ship comprising:

a groove formed in a ship's bottom, said groove extending from a bow side toward a stern side of the ship, said groove defining a water flow forming path;

a propeller disposed in the groove; and a rudder provided in said groove, said rudder facing toward said bow side.

2. The ship according to claim 1, wherein a bow side of the water flow forming path is formed to have a slope from a surface of the ship's bottom connecting to a path's bottom.

3. The ship according to claim 1, wherein a stream is formed in the water flow forming path from an opening in a bow side of the water flow forming path.

4. The ship according to claim 1, wherein:

the water flow forming path is formed at positions symmetrical to each other with a center line of the ship's bottom as a boundary; and each water flow forming path is provided with a propeller and a rudder therein.

5. The ship according to claim 2, wherein:

the water flow forming path is formed at positions symmetrical to each other with a center line of the ship's bottom as a boundary; and each water flow forming path is provided with a propeller and a rudder therein.

6. The ship according to claim 3, wherein:

the water flow forming path is formed at positions symmetrical to each other with a center line of the ship's bottom as a boundary; and each water flow forming path is provided with a propeller and a rudder therein.

7. The ship according to claim 1, wherein the water flow forming path is formed by partitions formed in parallel, the partitions protruding from an under surface of the ship's bottom.

8. The ship according to claim 1, wherein the ship comprises a motorboat, a boat, a ship, or a warship, said rudder and said propeller being arranged exclusively in said water flow forming path, wherein said ship's bottom extends to a position beyond a position of said rudder and a position of said propeller.

9. The ship according to claim 1, wherein the ship has an outboard motor;

a vertical channel in communication with the water flow forming path is formed in a stern surface of the ship;

the outboard motor is attached inside the vertical channel.

10. A water vehicle comprising:

a water engaging hull comprising a bow side, a stern side and a groove extending from said bow side in a direction of said stern side, said groove defining a water flow forming path, wherein fluid flows along said water flow forming path in a fluid traveling direction;

a propeller disposed in the water flow forming path; and a rudder disposed in said groove, downstream of the propeller, wherein the rudder has a pivot location downstream of a rudder movable side with respect to said fluid traveling direction, said rudder being arranged exclusively between said pivot location and said bow side.

11. The water vehicle according to claim 10, wherein a bow side of the water flow forming path is formed to have a slope from a surface of the hull upstream of the water flow forming path to a lower surface of the hull defining the water flow forming path, said water engaging hull comprising a hull bottom portion and a stern portion, said hull bottom portion extending to a position beyond a position of said rudder, said hull bottom portion and said stern portion defining an opening in a stern area of the water vehicle, said water flow forming path being in communication with said opening, wherein said rudder is located at a spaced location from said opening, said rudder being arranged in said water flow forming path, said rudder extending in a direction away from said stern portion.

12. The water vehicle according to claim 10, wherein the hull has an opening in a bow side communication with the water flow forming path.

13. The water vehicle according to claim 10, wherein:

plural water flow forming paths are formed at positions symmetrical to each other with a center line of a bottom of the water vehicle as a boundary; and each water flow forming path is provided with a propeller and a rudder therein.

14. The water vehicle according to claim 10, wherein the water flow forming path is formed by partitions formed in parallel, the partitions protruding from a remaining surface of the hull, one of said partitions being located at a spaced location from another one of said partitions.

15. A water vehicle comprising:

a water engaging hull comprising a groove, said groove defining a water flow forming path, said water flow forming path defining a fluid traveling direction;

a propeller disposed in the water flow forming path;

a rudder pivotably connected to said water engaging hull at a pivot location, said pivot location being located downstream of said propeller with respect to said fluid traveling direction, wherein said rudder extends exclusively between said propeller and said pivot location.

16. The water vehicle according to claim 15, wherein said water engaging hull comprises a hull bottom surface, said hull bottom surface extending beyond a position of said propeller and a position of said rudder.

17. The water vehicle according to claim 16, wherein:

said propeller is part of an outboard motor, said water engaging hull comprising a stern portion and a bow portion, at least said stern portion and said bottom surface defining an opening, said opening being in communication with said water flow forming path, said pivot location and said rudder being arranged at a spaced location from said opening, wherein said movable rudder side portion faces in a direction of said bow portion, said pivot location being located at a spaced location from said stern portion, said movable rudder side portion extending in a direction away from said stern portion.

18. The water vehicle according to claim 15, wherein:

said propeller is part of an outboard motor;

a vertical channel in communication with the water flow forming path is formed in a stern of the water vehicle; and the outboard motor extends inside the vertical channel

19. The water vehicle according to claim 10, wherein said water engaging hull comprises a hull bottom portion, said hull bottom portion extending to a position beyond a position of said rudder.

20. The water vehicle according to claim 19, wherein said water engaging hull comprises a stern portion, said hull bottom portion and said stern portion defining an opening in a stern area of the water vehicle, said water flow forming path being in communication with said opening, said rudder being located at a spaced location from said opening, said rudder being arranged in said water flow forming path, said rudder extending in a direction away from said stern portion and said opening.

* * * * *